United States Patent [19]

Brockbank

[11] 4,062,655

[45] * Dec. 13, 1977

[54] ARTIFICIAL FIRE PLACE LOGS WHICH BURN WITH COLORED FLAME AND PROCESS FOR MAKING SAME

[75] Inventor: William Hughes Brockbank, Salt Lake City, Utah

[73] Assignee: Business Controls, Inc., Salt Lake City, Utah

[ * ] Notice: The portion of the term of this patent subsequent to Jan. 25, 1989, has been disclaimed.

[21] Appl. No.: 166,551

[22] Filed: July 27, 1971

Related U.S. Application Data

[62] Division of Ser. No. 835,092, June 20, 1969, Pat. No. 3,637,355.

[51] Int. Cl.[2] ..... C10L 9/00; C10L 10/00

[52] U.S. Cl. ..... 44/6; 44/10 R

[58] Field of Search ..... 44/1 R, 10 R, 6, 14

[56] References Cited

U.S. PATENT DOCUMENTS

| | | | |
|---|---|---|---|
| 522,666 | 7/1894 | LeBel | 44/14 |
| 1,705,020 | 3/1929 | Kohr | 44/1 R |
| 1,750,371 | 3/1930 | Tanner | 44/6 |
| 2,219,565 | 10/1940 | Riemer | 44/1 R |
| 3,297,419 | 1/1967 | Eyre, Jr. | 44/10 R |
| 3,337,311 | 8/1967 | Lockhart | 44/10 R |
| 3,637,355 | 1/1972 | Brockbank | 44/1 R |
| 3,726,651 | 4/1973 | Ronden | 44/10 R |

*Primary Examiner*—Carl F. Dees
*Attorney, Agent, or Firm*—K. S. Cornaby

[57] ABSTRACT

An artificial fireplace log containing pyrogenic coloring matter which produces colored flames upon ignition of the log continuously until the log is consumed. The log is composed of combustible materials, preferably sawdust and wax, and contains pyrogenic coloring matter distributed throughout the log mix. Additional pyrogenic coloring matter is adhered to the surface of the log, preferably along two adjacent longitudinal sides corresponding to the top and front of the log as it is positioned in a fireplace. The process of the invention includes the steps of preparing an artificial log mix containing pyrogenic coloring matter, molding an artificial log with the mix, and adhering pyrogenic coloring matter, preferably in the form of dry, finely-divided particles, along the surface of the log.

9 Claims, 4 Drawing Figures

FIG. 1.
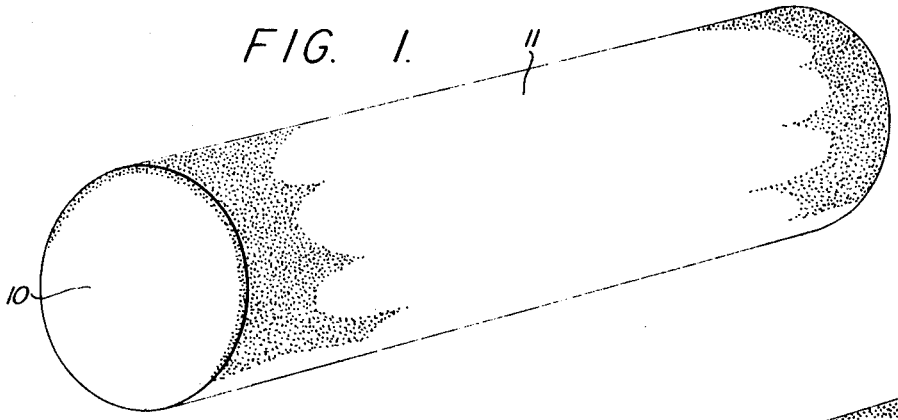
FIG. 2.
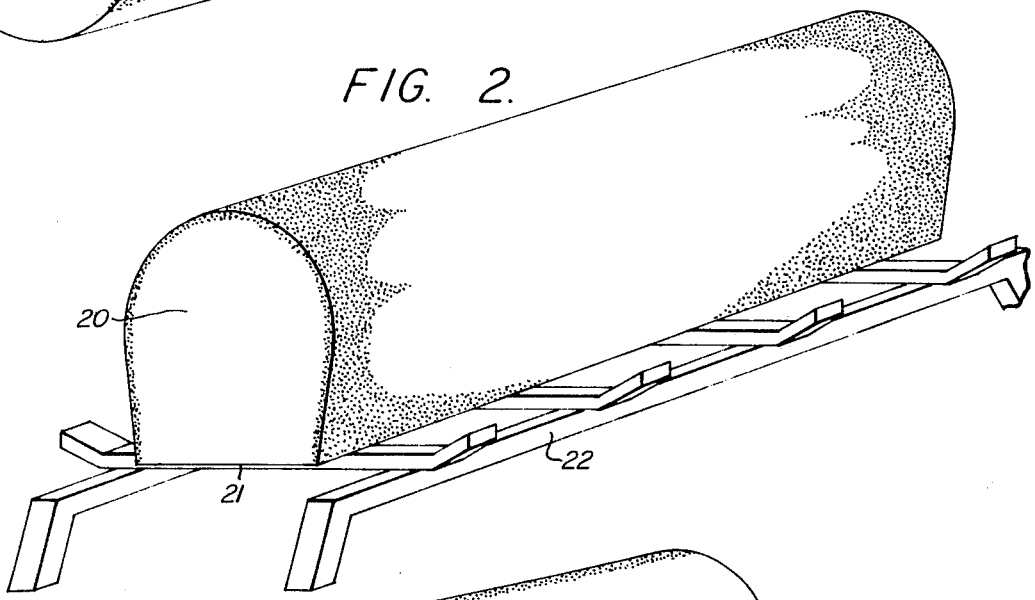
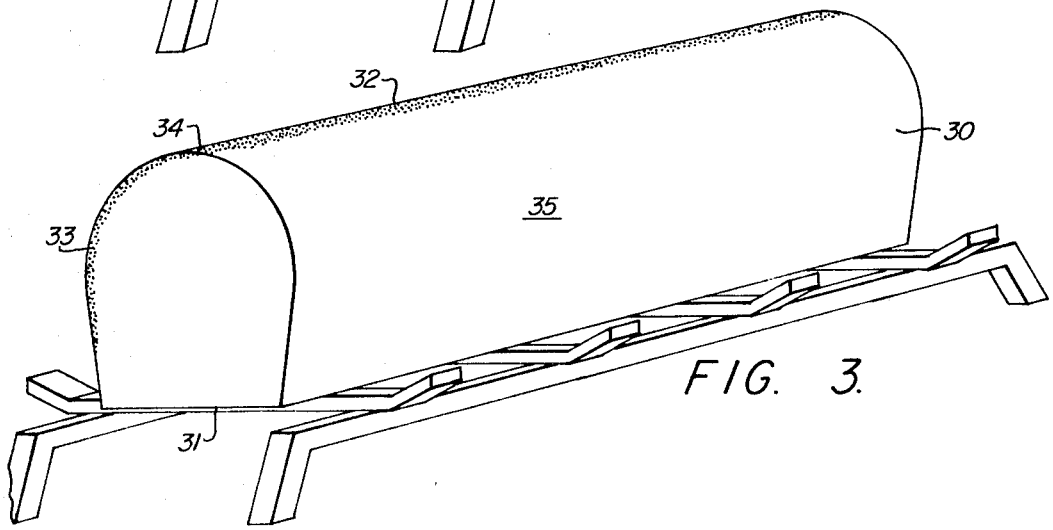
FIG. 3.
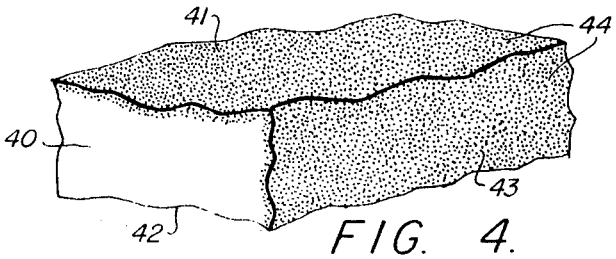
FIG. 4.
INVENTOR.
WILLIAM HUGHES BROCKBANK
BY Mallinckrodt & Conneley
ATTORNEYS

ARTIFICIAL FIRE PLACE LOGS WHICH BURN WITH COLORED FLAME AND PROCESS FOR MAKING SAME

BACKGROUND OF THE INVENTION

Related Application

This is a divisional application of allowed parent application Ser. No. 835,092 filed June 20, 1969 now U.S. Pat. No. 3,637,355 entitled "Artificial Fireplace Logs which Burn with Colored Flame."

1. Field

This invention relates to artificial fireplace logs having pyrogenic coloring matter which produces colored flames upon being burned.

2. State of the Art

Although many attempts have been made to produce a commercially acceptable artificial fireplace log which would exhibit colored flames upon ignition of the log and continuously until the log is consumed, prior to the making of this invention no such logs were available on the market. It has been common practice to sprinkle flammable metallic salts on burning natural logs to produce locally colored flames for short periods of time, but this practice does not produce sustained coloration of the flames from the time the log is ignited until final expiration of the flame.

OBJECTIVES

It was a purpose in making this invention to produce an artificial log which would burn with various colored flames continuously from ignition of the log to final consumption thereof.

SUMMARY OF THE INVENTION

The process of the invention is practiced by formulating an artificial log mix containing combustible materials. The customary mix in use today and the one preferred for use with this invention is a mix consisting essentially of sawdust and wax. An effective amount of preferably dry, discrete particles of pyrogenic coloring matter for imparting coloration to the flames is admixed with the log to distribute them throughout the mix. The log mix containing the pyrogenic coloring matter is molded into a log, and an additional effective quantity of discrete particles of pyrogenic coloring matter is adhered to the surface of the log by dusting or other suitable means, such as spraying, dipping or the like.

The resulting log, when burned, will produce colored flames virtually upon ignition of the log and will provide such colored flames continuously throughout the burning of the log. In a preferred construction, one longitudinal side of the log has a flat surface which is used for solidly seating the log upon a grate or other log-holding means in a fireplace, so that the log does not move or roll as it burns. This also permits the log to be placed in a fireplace with the top and front side of the log facing the front of the fireplace. It is preferred that the particles of pyrogenic coloring matter be adhered to the surface of the log longitudinally of the log along two adjacent sides, corresponding to the top and front side of the log as it would be positioned in a fireplace. This arrangement provides for efficient utilization of the pyrogenic coloring matter, since the flames located at the bottom and rear side of the log cannot be seen from the front of the fireplace.

As disclosed in my allowed parent application, chlorinated vinyl polymers and co-polymers provide a bright, colorful green flame when used as flame colorants in fireplace fires. Such resins decompose at relatively low temperatures, enabling them to be used in any form with virtually any combustible material which can be burned in a fireplace, including natural wood.

THE DRAWING The best mode presently contemplated for practicing the invention is illustrated in the accompanying drawing, in which:

FIG. 1 illustrates a log having a cylindrical configuration with superficially adhering particles of pyrogenic coloring matter;

FIG. 2, a view of a log of the invention having a longitudinal, flat side corresponding to the bottom of the log;

FIG. 3, a log of the invention having particles of pyrogenic coloring matter adhering only to the top and front side of the log; and FIG. 4, another embodiment of the invention in which the artificial log is in the form of a briquette.

DETAILED DESCRIPTION OF THE ILLUSTRATED EMBODIMENT

As shown in FIG. 1, a log 10 of the invention is customarily cylindrical in form and is composed primarily of combustible materials admixed with flame coloring matter. Preferably dry, discrete particles of additional pyrogenic coloring matter 11 are distributed over the surface of the log and adhered thereto.

In FIG. 2, the preferred log 20 of the invention has a flat surface 21 which acts as the bottom of the log when it is placed on a grate 22 in a fireplace. The log is thereby prevented from rolling out of position as when placed on a grate or when partially burned.

As illustrated in FIG. 3, a log 30 having a flat bottom 31 serves the additionally important function of providing a reference point for positioning the log in a fireplace when only the top 32 and front sides 33 of the log 30 have adherent particles of pyrogenic coloring matter 34. The resulting colored flames (not shown) along the top 32 and front sides 33 of the log 30, when burned, are seen from the front of the fireplace (not shown). The rear side 35 of the log 30 does not have particles of pyrogenic coloring matter adhered to its surface. If it is desired to wrap such a log in paper or other combustible material for purposes of marketing, directions as to placement of the log in the fireplace to achieve maximum exposure of the colored flames can be printed clearly on the wrapping material which is left on the log and serves as an aid to igniting th log.

Although the traditional log-shaped artificial log having a flat surface along one longitudinal side is preferred from both a practical and an aesthetic standpoint, it is also within the contemplation of the invention that such artificial logs may take other shapes and forms. For example, as illustrated in FIG. 4, the log may take the form of a briquette 40 having a flat top 41, a flat bottom 42, and a flat front side 43. In this embodiment, the particles of pyrogenic coloring matter 44 can be adhered to the top 41 and front 43 of the briquette 40.

The log of the invention is not restricted to producing a single colored flame. Several differently colored flames can be produced either intermingled with one another, or in separate bands or strips along the log. For example, the surface of the log can be divided into three or four bands around the circumference of the log. Each band contains coloring matter producing a differently colored flame, resulting in a very pleasing and striking effect.

Although in many instances it may be preferred to utilize the same flame colorant within the log mix as is used to adhere superficially to the surface of the log, this need not be so. As an example, it is possible to use one type of flame colorant admixed with the log mix, and a second type as the superficially adhering coloring matter. It is also possible to combine different flame colorants which produce differently colored flames and use the combination to effect new flame colors by admixing the combination with the log mix and/or using it as the superficially adhering coloring matter.

The screen particle size of the flame colorant particles is preferably 20 mesh or smaller for convenience in handling and mixing. However, larger size particles can be used if necessary or desirable.

As the log begins to burn and the temperature in the interior of the log rises, the wax contained within the log vaporizes and carries the decomposing, interior flame colorants with it to the surface of the log, where they are consumed by the flames, thereby providing additional coloration to the flames. The combination of the adhered coloring matter on the surface of the log and the distributed coloring matter within the log serve to provide a continuous coloration of the flames throughout the burning of the entire log. As the surface coloring matter is consumed, the coloring matter within the log replenishes the surface coloring matter available for coloring the flames.

The presence of flame colorant in the interior of the log without additional adhered flame colorant adhered to the surface of the log does not produce colored flames upon igniting the log. The flame colorant admixed within the log does not begin to produce colored flames until about 30 - 40 minutes after the log has been ignited. For instantly colored flame to appear as the log is ignited there must be additional amounts of superficially adherent flame colorant on the surface of the log. It has been found that faint coloration of the flames can be perceived upon ignition with somewhat under one-fourth ounce flame colorant adhered to the surface of the log. Good color is achieved with about one-half ounce flame colorant, and excellent color is attained with about three-fourths ounce colorant. Amounts above three-fourths ounce can be employed, but the cost of the colorants is substantial and increased amounts of colorant increase the expense significantly without compensating increase in brilliance of color over the colors exhibited with the three-fourths ounce colorant. It is preferred to place the colorant in a strip approximately 1/2 inch wide just at one side of the center top of the log. The major portion of the colorant particles adheres to the log at that point, but the remainder falls down the side, or front, of the log to provide a light coating along the one side of the log.

Polyvinyl chloride or other polyvinyl chlorinated resins in combination with metallic salts known to impart coloration to flames provides what appears to be a synergistic effect in imparting coloration to flames. The synergistic effect has been most significant when polyvinyl chloride has been mixed with copper sulfate and used in accordance with the invention. Although either the polyvinyl chloride or the copper sulfate alone will provide a colored flame effect when used as set forth in the process of the invention, an even brighter, more striking, turquoise coloration effect is achieved when the two are combined in a formation which is adhered to the surface of the artificial log. When such a formulation is adhered to the surface of the log, it is sufficient to use the chlorinated vinyl polymer alone in the log mix, thereby achieving an economic advantage. It has been found advantageous to facilitate the distribution of the particulate chlorinated vinyl resins and/or metallic coloration salts by incorporating extenders, such as ammonium chloride, in the colorants to more easily control the concentration of the colorants within the log mix and on the surface of the log.

As described above, the preferred composition for an artificial log mix comprises sawdust and wax. The formulation can contain other binders and additives which contribute to the stability of the log if desired. However, other combustible materials and binders can also be used in the process of the invention. For example, paperwaste, wood chips, powdered coal, peat moss, and petroleum coke, can be utilized as combustible materials. A preferred apparatus for making the logs of the invention is described in my co-pending allowed application entitled "Apparatus for Making Artificial Fireplace Logs Having Colored Flames", U.S. Pat. No. 3,696,639.

The following example of a typical log mix and flame colorant dusting formulation is provided for purpoes of illustration.

EXAMPLE

In a 450 lb. batch of log mix containing sawdust and wax which produced 78 logs, the following ratios of supplementary ingredients were employed:

A. A 12 lb. mixture of additives was prepared comprising:
- 2.4 lbs. polyvinyl chloride
- 4.2 lbs. copper sulfate
- 4.2 lbs. ammonium chloride
- 0.2 lbs. talc
- 2.0 lbs. wood flour 8 lbs. of the mixture was added to the log mix and 4 lbs. used for dusting the surface of the logs.

B. 4 lbs of polyvinyl chloride were added to the log mix, and 4 lbs. of the mixture described in (A) above were used for dusting.

C. 2 lbs. of polyvinyl chloride were added to the log mix, and 4 lbs. of the mixture described in (A) above were used for dusting.

Whereas this invention is illustrated and described herein with respect to certain preferred forms thereof, it is to be understood that many variations are possible without departing from the inventive concepts particularly pointed out in the claims.

I claim:

1. An artificial log having pyrogenic flame coloring matter, comprising a shaped, hardened mixture of combustible materials having an effective amount of pyrogenic flame coloring matter distributed within the mixture, and having an additional effective amount of pyrogenic flame coloring matter superficially adherent to the surface thereof.

2. An artificial log as set forth in claim 1, wherein the shaped, hardened mixture includes at least wax and sawdust.

3. An artificial log as set forth in claim 1, wherein the superficially adherent pyrogenic flame coloring matter is in particulate form.

4. An artificial log as set forth in claim 1, wherein the superficially adherent pyrogenic flame coloring matter is restricted to the localized surface area extending along the two adjacent longitudinal sides of the log.

5. An artificial log as set forth in claim 1, wherein at least one longitudinal side of the log has a substantially flat surface for resting upon log-supporting means in a fireplace.

6. A process for producing artificial logs exhibiting colored flames when burned, comprising the steps of:

admixing particles of combustible material, a binder, and pyrogenic flame coloring matter to form an artificial log mix;

molding an artificial log with said artificial log mix; and adhering additional pyrogenic flame coloring matter superficially to the surface of said artificial log.

7. A process as set forth in claim 6, wherein said adhering pyrogenic flame coloring matter is applied to a localized surface area of said log extending along two adjacent longitudinal sides of the log.

8. A process as set forth in claim 6, wherein said log is molded with one longitudinal side having a flat surface for resting on log-supporting means in a fireplace.

9. A process as set forth in claim 6, wherein said superficially adhering pyrogenic flame coloring matter is in particulate form.

* * * * *